United States Patent [19]

Krueger et al.

[11] Patent Number: 4,592,221

[45] Date of Patent: Jun. 3, 1986

[54] METHOD OF AND AN ARRANGEMENT FOR PRODUCING THREADS

[75] Inventors: Eberhart Krueger, Mölln; Helmut Künsken, Schwarzenbek, both of Fed. Rep. of Germany

[73] Assignee: Wilhelm Fette GmbH, Schwarzenbek, Fed. Rep. of Germany

[21] Appl. No.: 567,785

[22] Filed: Jan. 3, 1984

[30] Foreign Application Priority Data

Jan. 3, 1983 [DE] Fed. Rep. of Germany ..... 3300029

[51] Int. Cl.[4] ..... B21H 3/04

[52] U.S. Cl. ..... 72/84; 72/104

[58] Field of Search ..... 72/84, 98, 103, 104, 72/108, 118

[56] References Cited

U.S. PATENT DOCUMENTS

| | | | |
|---|---|---|---|
| 1,145,661 | 7/1915 | Bailey | 72/104 |
| 2,011,761 | 8/1935 | Handel | 72/104 |
| 2,576,709 | 11/1951 | Affleck | 72/104 |
| 2,771,799 | 11/1956 | Batchelder | 72/104 |

*Primary Examiner*—Lowell A. Larson

*Attorney, Agent, or Firm*—Michael J. Striker

[57] ABSTRACT

An axial thread roll head is used for producing threads on workpieces, arranged on a rotary disk of a numerically controlled automatic lathe and has two threaded rolls which, after rolling of a thread, are withdrawn in the same direction transversely to a workpiece with constantly retained opposite distance from the workpiece tangentially relative thereto.

7 Claims, 5 Drawing Figures

$$X_Z < X_G$$

$$X_G - X_Z = \frac{So}{2} \qquad - X_G = l$$

$$S = \frac{So}{2} \left( 2 - \frac{X_G}{l} \right)$$

$$X_Z = -So + X_G \left( 1 + \frac{So}{2l} \right)$$

$$X_G = n_E \cdot p$$

METHOD OF AND AN ARRANGEMENT FOR PRODUCING THREADS

BACKGROUND OF THE INVENTION

The present invention relates to a method of and an arrangement for producing threads on workpieces.

More particularly, the present invention relates to a method of producing threads on workpieces with an axial threaded roll head provided with two threaded rolls arranged on a rotary disk of a numerically controlled automatic lathe, as well as an arrangement for performing the method.

It is known for rolling a thread on a workpiece to axially displace the threaded roll head and after rolling of the thread to withdraw the threaded roll radially from the workpiece with the aid of eccentrics and a mechanism by which the rolls are radially turned from the workpiece. After this, the roll head is axially moved back. Subsequently the threaded roll head must be shut.

In accordance with another known method of producing threads, the threaded rolls after rolling of the thread rotate back, so that no turning is needed. For the use of computer numbered controlled automatic lathes with a transverse axial and height-adjustable rotary disk on a carriage for receiving a threaded roll head or automatically controlled rotary machines of another type, the known axially threaded roll heads are not suitable since they require considerable efforts to shut again the threaded roll head after the radial turning of the threaded rolls, for conducting a further working step. A further disadvantage is that it is not possible to roll on a workpiece a thread, when the workpiece is clamped in a lathe between two points so that the axial displacement is not possible.

SUMMARY OF THE INVENTION

Accordingly, it is an object of the present invention to provide a method of and an arrangement for producing threads which avoids the disadvantages of the prior art.

More particularly, it is an object of the present invention to provide a method of producing threads in accordance with which an axial threaded roll head can be used for rolling a thread or an automatic lathe without special mechanical efforts to close after a rolling step the opened threaded roll head again.

It is another object of the present invention to provide an arrangement for performing the inventive method of producing threads.

In keeping with these objects and with others which will become apparent hereinafter, one feature of the present invention resides, briefly stated, in a method of producing threads, in accordance with which the threaded rolls after rolling of a thread, are withdrawn in the same direction transverse to a workpiece with constantly retained opposite distance from the workpiece tangentially relative thereto.

The delivery of the threaded roll head for beginning of the rolling step can be performed both in an axial direction and in a radial direction. Therefore also rolling of a thread on a workpiece is possible, which is clamped between two points.

When a tangential displacement of the threaded rolls is mentioned here, this means the peripheral surface of the threaded rolls relative to the outer periphery of the workpiece, so that the threaded roll head is radially withdrawn from the workpiece.

With the utilization of the inventive method, the axes of the threaded roll can be fixedly held in a fork-shaped bracket of the threaded roll head or a support, in accordance with another feature of the inventive arrangement.

Still another feature of the arrangement is that the axles of the threaded rolls on which they are supported, are formed as eccentric pins.

It is a further feature of the present invention that the threaded rolls are supported axially displaceable against the pressure of springs provided therefor.

The threaded rolls are seated freely rotatably on the axles. It is not necessary for the beginning of the rolling step that they assume any fixed initial position. Here, grooved rolls can be used with their axes which are inclined relative to one another substantially at the pitch angle of the thread to be produced, so that their axes are not parallel to one another. The axis of one roll is inclined relative to the axis of the other roll, so that the axes are not straight relative to one another, but instead are inclined in parallel planes to one another.

The angle between the inclined axes and the axis of the threaded roll head substantially corresponds to the pitch angle of the thread to be rolled.

In the method and the arrangement in accordance with the present invention, it is not necessary after a forward displacement of the finished workpiece to again adjust the threaded rolls in a kind of a closing step of the threaded roll head. Therefore, with the especially simple axial thread roll head, new possibilities for their use in NC or CNC automatic lathes are provided and rolling of threads of any length is possible.

The novel features which are considered characteristic for the invention are set forth in particular in the appended claims. The invention itself, however, both as to its construction and its method of operation, together with additional objects and advantages thereof, will be best understood from the following description of specific embodiments when read in conjunction with the accompanying drawing.

DESCRIPTION OF A PREFERRED EMBODIMENT

Figure 1:
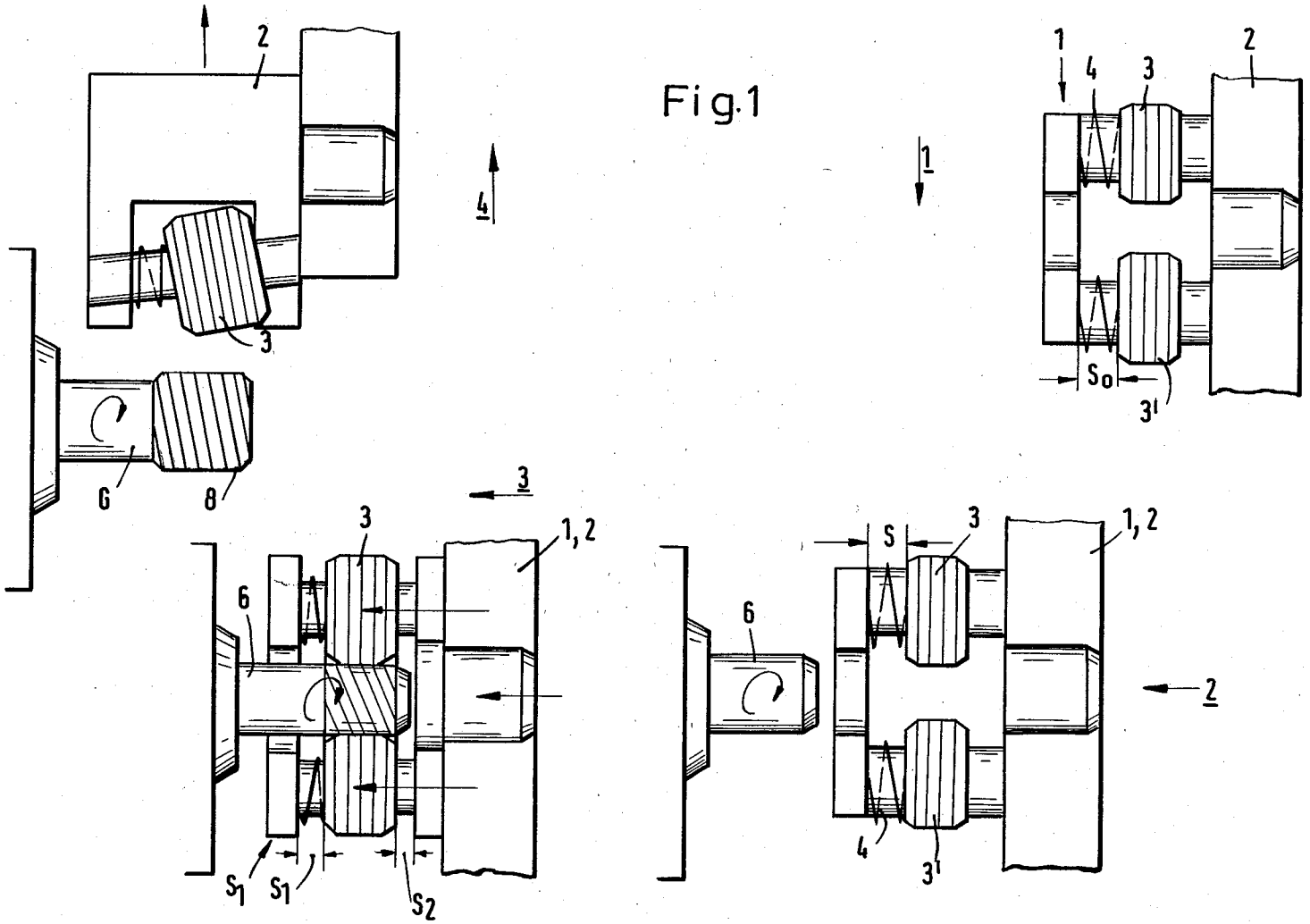
FIG. 1 is a view showing various positions of a threaded roll head during a rolling process, in accordance with the present invention.
Figure 2:
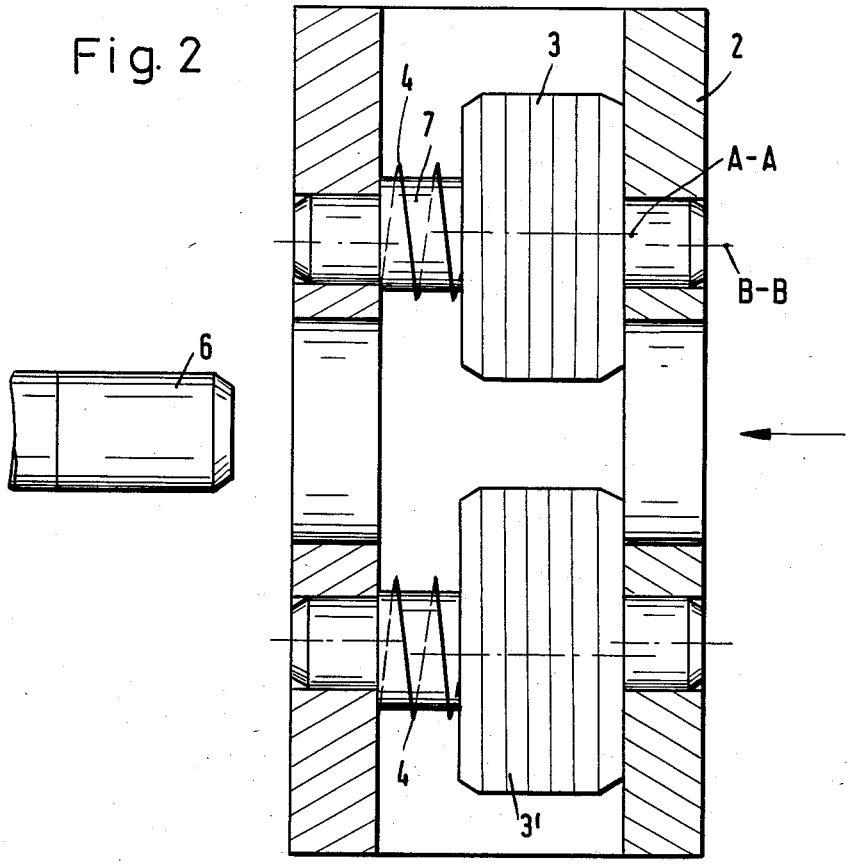
FIG. 2 is a side view of a threaded roll head in accordance with the present invention.

An arrangement in accordance with the present invention has an axial threaded roll head 1 which includes a fork 2. The fork 2 is open at its one side and carries two threaded rolls 3 and 3'. Both threaded rolls 3 and 3' are arranged at a fixed distance from one another and mounted in a freely rotatable manner on an eccentric pin 7 which compensates for dimensional inaccuracies by a springing off of fork 2 of the threaded roll head.

The eccentric portion of the eccentric pin 7 with the axis A—A is offset from the axis B—B of the threaded roll. The axis A—A corresponds to the axis of rotation of the threaded roll 3, whereas the axis B—B corresponds to the axis of rotation of the eccentric pin 7, which carries the threaded roll 3. By rotation of the eccentric pin 7, the threaded roll 3 can be adjusted radially.

Figure 3:
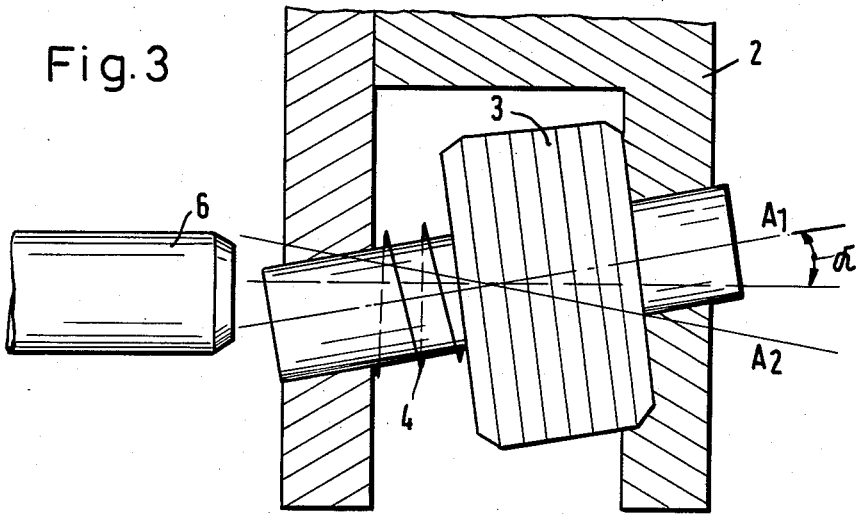
FIG. 3 is a plan view of a threaded roll head in accordance with the present invention.

The axes $A_1$ and $A_2$ of both threaded rolls 3 and 3' are inclined relative to one another, as shown in FIG. 3. The angle $\alpha$ which is formed between these two axes and the axis of the threaded roll head 1 substantially corresponds to the pitch angle of the threads 8 to be produced.

Figure 4:
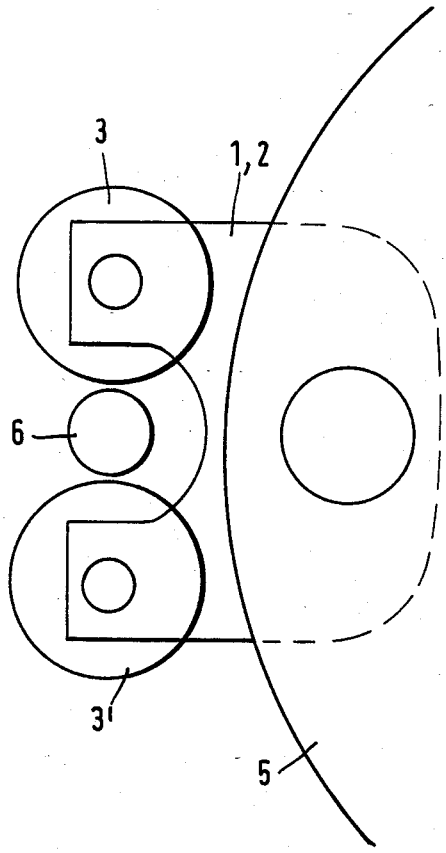
FIG. 4 is a view showing an arrangement of a threaded roll head in accordance with the present invention on a rotary disk of an automatic lathe.

When the threaded roll head 1 is arranged on a rotary disk 5 of an automatic lathe in correspondence with FIG. 4, the feed of the threaded roll head 1 for producing a thread on a workpiece 6 can be performed both radially and axially, in correspondence with the positions 1 and 2 of FIG. 1. The production of the thread is performed then by axial movement of the threaded roll head in correspondence with the position 3 in FIG. 1. At the end of the rolling step the threaded roll head is withdrawn radially in correspondence with the position 4 in FIG. 1 from the workpiece 6. The threaded rollers 3 and 3' moves tangentially further from the workpiece 6. This tangential further movement in condition of a high speed working process can take place normally to the axis of the workpiece 6, especially taking into consideration that the threaded rolls are axially displaceable and supported against the pressure of the spring 4 on their axles. Thereby during the quick return they can axially displace without damaging the formed thread. The spring 4 serves as a return device for the threaded rollers 3 and 3' after the end of the rolling step. If the springs 4 were not available, the threaded rollers 3 and 3' after the end of the rolling step would remain in axially displaced position. In the beginning of a new rolling step they would be able, however, to displace by the workpiece 6 in the required initial position, so that the arrangement of the spring is not absolutely necessary.

Figure 5:
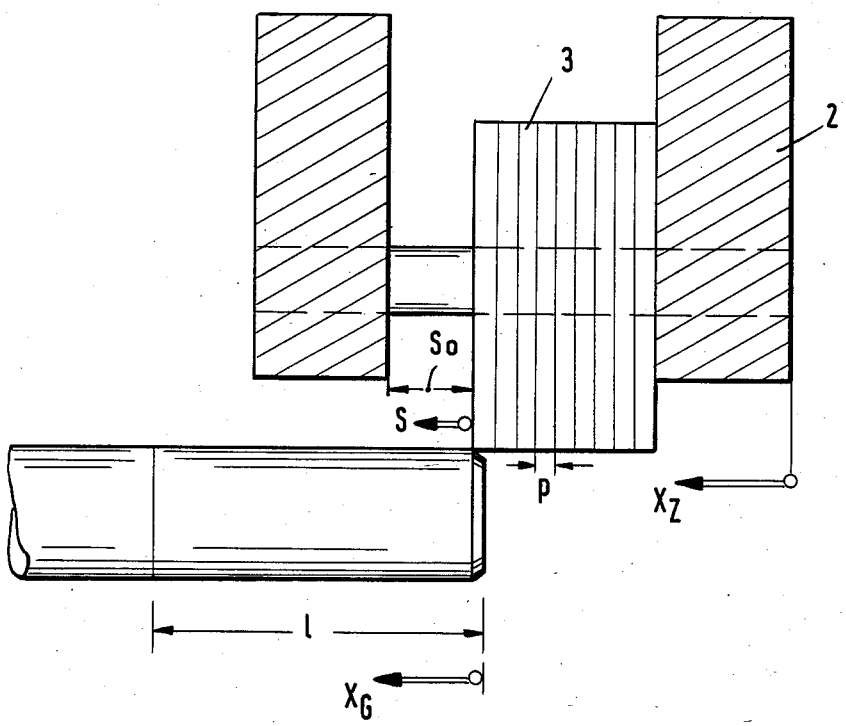
FIG. 5 is a partial section of a threaded roll head with a workpiece, with respective mathematical actuations.

FIG. 5 shows that it is advantageous when the positive feed path $X_2$ is smaller than the feed $X_G$ which is required for the inclination and the difference corresponds to the amount $S_o/2$ when the length 1 of the thread to be produced corresponds to the value $X_G$. Thus, the possible path of the feed of a threaded roll on its axle or the play S corresponds:

$$S = \frac{S_o}{2} \times \left(2 - \frac{X_G}{2L}\right)$$

The positive feed path $X_z$ corresponds to:

$$X_z = -S_o + X_G\left(1 + \frac{S_o}{2L}\right)$$

wherein the feed path required for inclination $X_G = n_E \cdot p$ or the product of the number of revolutions of the workpiece with the pitch of the thread.

When such a positive feed path $X_z$ is selected, the threaded rolls 3 and 3' in the end of the rolling step stay over the entire thread length 1 in the central position $S_o/2$ of its axial play, so that during withdrawal of the threaded roll head 1 both threaded rolls because of the inclined position of their axles can displace axially identically in opposite direction and thereby prevent a damage to a thread during withdrawal of its threaded roll head.

This consideration takes place in the inventive production of a single thread whose pitch corresponds to the value p, and also the groove pitch of the threaded rolls and the thread inclination of the workpiece 6.

During the rolling step corresponding to the position 3 in FIG. 1, the play space $S_0$ is subdivided into the spaces $S_1$ and $S_2$. It is advantageous when after the end of the rolling step the values $S_1$ and $S_2$ are identical or correspond to the value $S_0/2$ in both threaded rolls so that during withdrawal of the threaded roll head they can displace in opposite directions. The displacement of the threaded rolls takes place by programming of the positive feed $X_z$ of the machine. It is assumed that the positive feed of the threaded roll head 1 which are provided by the machine is smaller than the feed $X_G$ of the threaded rolls 3 and 3' which takes place because of the pitch of the produced thread. Thereby the individual threaded rolls 3 and 3' displace on their axes in such a manner that, instead of the original play $S_0$, a play takes place in the value $S_0/2$, which is advantageous for preventing during tangential withdrawal of the threaded rolls any damage to the produced thread of the workpiece 6.

It will be understood that each of the elements described above, or two or more together, may also find a useful application in other types of constructions differing from the types described above.

While the invention has been illustrated and described as embodied in a method of and an arrangement for producing threads, it is not intended to be limited to the details shown, since various structural and procedural changes and modifications may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of producing threads on workpieces, comprising the steps of providing an axial-type thread rolling head which has two thread rolls with a plurality of discrete annular grooves and axes inclined relative to one another, and is arranged on a turret of a numerically controlled automatic lathe; bringing the thread rolling head into a rolling position by moving in transverse direction with the thread rolls being brought in a position above a center line of the workpiece; rolling a thread by axial displacement of the thread rolls relative to a workpiece; and subsequently withdrawing the thread rolls from the workpiece in tangential direction by means of the thread rolling head being moved back transversely from the workpiece with constantly retained opposite distance of the thread rolls to one another.

2. A method as defined in claim 1, wherein said withdrawing step includes oppositely axially displacing said threaded rolls.

3. A method as defined in claim 1, wherein said providing step includes providing the two threaded rolls which are axially displaceable with a predetermined axial play, said rolling step including selecting a positive feed of the threaded roll head so that the axially displaceable threaded rolls at the end of rolling are in a medium position of their axial play.

4. An arrangement for producing threads on workpieces, comprising an axial-type thread rolling head provided with two thread rolls which have a plurality of discrete annular grooves and axes inclined relative to one another, and arranged on a turret of a numerically controlled automatic lathe; means for bringing the thread rolling head into a rolling position by moving in transverse direction with the thread rolls being brought in a position above a center line of the workpiece, and displacing said threaded rolls axially relative to a workpiece so as to roll a thread on the latter; means for subsequently withdrawing said thread rolls from the workpiece in tangential direction by means of the thread rolling head being moved back transverse from the workpiece with constantly retained opposite distance of the thread rolls to one another; and means for arranging said threaded roll head on a turret of an automatic lathe.

5. An arrangement as defined in claim 4, wherein said thread rolling head is provided with a fork-shaped supporting member which is open at its one side and supports said thread rolls so that their axes are arranged at a fixed distance from one another.

6. An arrangement as defined in claim 4; and further comprising spring means arranged so that said thread rolls are supported in said supporting member axially displaceable against the pressure of said spring means.

7. An arrangement as defined in claim 5; and further comprising axial members arranged to support said thread rolls in said supporting member, said axial members being formed as eccentric pins.

* * * * *